US005184113A

United States Patent [19]

Baron

[11] Patent Number: 5,184,113

[45] Date of Patent: Feb. 2, 1993

[54] ELECTRICAL FIELD DISPLAY/SIGNAL DEVICE

[76] Inventor: Greg Baron, 5434 W. 31st St., Cicero, Ill. 60650

[21] Appl. No.: 784,128

[22] Filed: Oct. 29, 1991

Related U.S. Application Data

[63] Continuation of Ser. No. 590,944, Oct. 1, 1990, abandoned.

[51] Int. Cl.[5] ..... G08B 21/00

[52] U.S. Cl. ..... 340/635; 340/654; 315/291; 361/290

[58] Field of Search ..... 340/635, 656, 654; 315/DIG. 4, 283, 291, 293; 361/290

[56] References Cited

U.S. PATENT DOCUMENTS

| | | | |
|---|---|---|---|
| 1,634,930 | 7/1927 | Brockway | 361/290 |
| 1,684,917 | 9/1928 | Hammarlund | 361/290 |
| 3,533,094 | 10/1970 | Brelje | 340/654 |
| 3,911,320 | 10/1975 | Crawford et al. | 315/DIG. 4 X |
| 4,089,032 | 5/1978 | Dell Orfano | 340/656 X |
| 4,515,105 | 5/1985 | Danta et al. | 118/629 |
| 4,559,479 | 12/1985 | Munson | 315/DIG. 4 X |
| 4,725,772 | 2/1988 | Peak | 340/654 X |

*Primary Examiner*—Jin F. Ng
*Assistant Examiner*—Jeffery A. Hofsass
*Attorney, Agent, or Firm*—Hill, Steadman & Simpson

[57] ABSTRACT

An electrical field display and/or display device which in a preferred embodiment provides a visual display indicating operation of an electrical field generator used to disperse a powdered substance and an audible display indicating non-operation of the electrical field generator. The device is carried in a housing which has an opening therein to permit viewing of the visual display which preferably is in the form of a neon lamp. The device may also provide a signal in response to non-operation of the electrical field generator to initiate or terminate operation of another device.

13 Claims, 1 Drawing Sheet

ELECTRICAL FIELD DISPLAY/SIGNAL DEVICE

This is a continuation of application Ser. No. 590,944, filed Oct. 1, 1990 now abandoned.

BACKGROUND OF THE INVENTION

The present invention relates generally to a display and/or signal generating device and more particularly to a device for visibly and/or audibly displaying the status of an electrical field and/or generating a signal in response to a status of the electrical field.

In some environments where an electrical field generator is used, for example in printing presses where a neon tube is utilized to provide an electrical field to disperse ink absorbing compounds, such as powdered corn starch, it is highly desireable for the operator to be continuously informed about whether the electrical field is being generated. When a neon tube is used to generate the electrical field, sometimes such an indication is available if the operator is able to look into the machinery to the location of the neon tube to see if it is giving off light. However, oftentimes even when the neon tube is operating, it becomes covered with the powder thereby obstructing the view of the light to the operator. Further, the operator must be positioned very accurately in order to observe the neon tube which is positioned in the interior of the machinery. Thus, if the operator does not happen to be standing in the right spot, he will not be alerted to the termination of the electrical field, for example if the neon tube were to break or if there were a disruption in the power being supplied to the neon tube.

It therefore would be beneficial if there were a readily observable display device or signal generator which would positively display to the operator or signal another device that the electrical field generator was in fact operating correctly. It would be a further improvement if the operator or other device would be positively alerted or signaled upon the termination of the generation of an electrical field.

SUMMARY OF THE INVENTION

The present invention provides a display device and/or signal generator which can be connected to an electrical field generator so as to provide a readily observable display to an operator or other appropriate signal confirming that the electrical field generator is in operation. Preferably this display would be a visual display, such as the lighting of a lamp. The lamp could be positioned in a readily observable position such that an operator could readily observe the visual signal throughout a wide range of locations.

The present invention also alternately or supplementally provides for a signal to be displayed to the operator or other device upon non-operation of the electrical field. In a preferred embodiment such optional signal could be an audible signal which would alert the operator to a failure of the electrical field generator.

Of course, different display signals could be provided, such as both signals being visual signals, both signals being audible signals, or other signals such as to cause termination of power to the device utilizing the electrical field.

DESCRIPTION OF THE PREFERRED EMBODIMENTS

Figure 1:
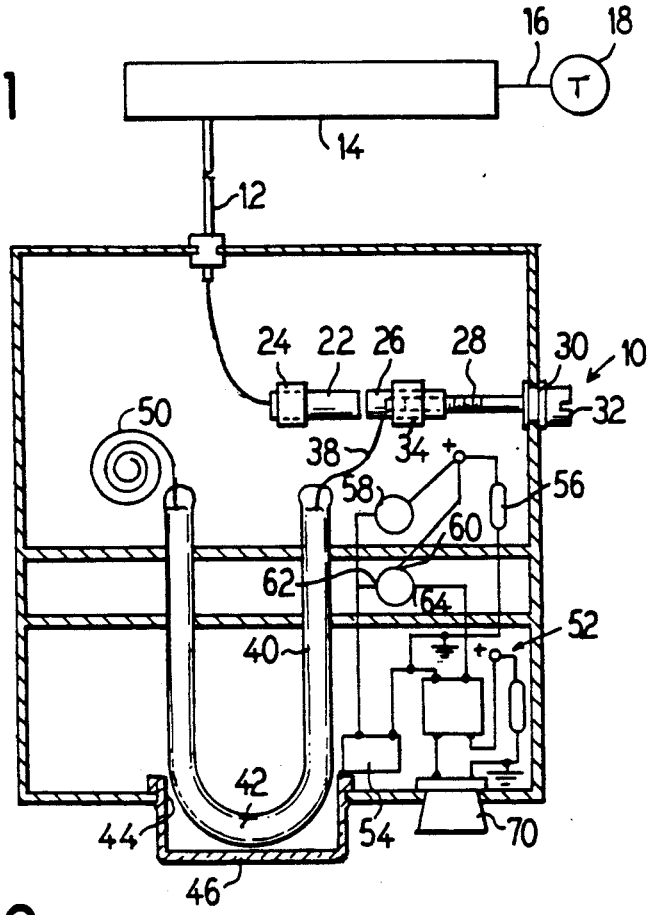
FIG. 1 is a plan view of the interior of a display device embodying the principles of the present invention.
Figure 2:
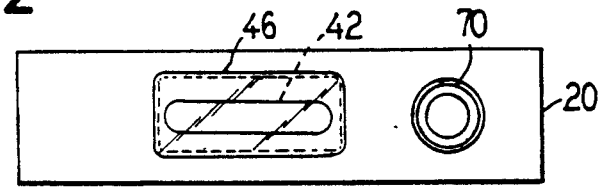
FIG. 2 is a front elevational view of a display device embodying the principles of the present invention.
Figure 3:
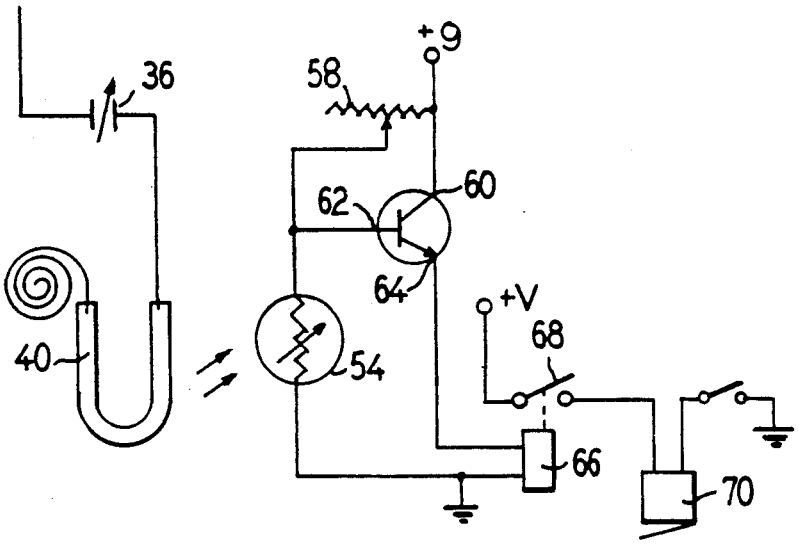
FIG. 3 is an electrical schematic diagram of a display device embodying the principles of the present invention.

Although a preferred embodiment of the invention is disclosed as being a display device for an electrical field generator used to disperse a powered substance such as corn starch in a printing press, it should be understood that the invention is not so limited. That is, the display device can be provided to display to an operator the presence and/or absence of an electrical potential in any kind of a device and also can be used to generate a signal for purposes other than display to an operator, for example to terminate or initiate operation of another device.

The preferred embodiment of the invention is illustrated in the drawings wherein a display device 10 is operatively connected, preferably by means of an electrical conductor 12, to an electrical field generator 14 which maybe a neon tube, or other device having an alternating electrical potential. Such devices would be connected by means of an electrical connection 16 to a source 18 of alternating current such as a transformer.

The electrical conductor 12 is connected within a housing 20 to a fixed terminal block 22. It has been determined that a brass cylinder, secured to the housing 20 by a clip 24 provides an optimum terminal. Stainless steel was tried as a terminal block, but was determined to be inoperative after a very short period of use, apparently due, at least part, to oxidation of the metal. A second brass cylinder terminal block 26 is carried on a non-electrically conductive threaded shaft 28 which extends through a captured threaded nut 30 secured to the housing 20. The shaft 28 has a manipulable head 32, such as a screw driver slotted head positioned on the exterior of the housing 20. The second brass cylinder 26 is loosely captured in a mounting holder 34. Rotation of the threaded shaft 20 by manipulation of the head 32 will cause axial movement of the second cylinder 26 relative to the first cylinder 22 thereby selectively varying the size of a gap 36 between the two cylinders. An electrical conductor 38 connects the second cylinder 26 with a display device, such as a neon tube 40. The neon tube 40 has a portion 42 visible from the exterior of the housing 20 through an opening 44 in the housing wall which, preferably, is covered with a colored lens 46. A second terminal 48 of the neon tube 40 is connected to an isolator 50 in the form of a length of coiled wire. The isolator 50 permits a slow dissipation of charge and thus allows a small current to flow through the neon tube 40.

In this manner, as long as the electrical field generator 14 is operating, that is, as long as it is being supplied with an alternating potential, that potential will be provided to the neon tube 40 so as to provide a visual display of the operating status of the electrical field generator 14. The adjustability of the gap 36 by means of the threaded shaft 28, allows for a "tuning" of the circuit to provide a maximum brightness of the neon tube 40.

An optional additional signal generating device 52 may be provided to detect and provide a signal in the event that the electrical field is not operating. In the preferred embodiment, a photocell 54 is placed in close proximity to the neon tube 40 to detect whether the neon tube is illuminated. An independent source of power, preferably in the form of a battery 56, provides voltage to the photocell through a variable resistor or rheostat 58. This same battery can provide a voltage potential to a collector 60 of an npn silicon transistor 61. A base 62 of the transistor would be provided with a lesser voltage of a value depending upon the resistance values of the rheostat 58 and photocell 54 which act as a voltage divider. An emitter 64 of the transistor may be connected to a device 66, such as a relay. As the photocell receives light, the resistance therethrough is low thus providing only a minimum voltage potential at the base 62 of the transistor 61 thus preventing a supply of voltage to the relay 66. However, when light to the photocell 54 terminates, the resistance of the photocell increases. This increases the voltage supply to the base 62 of the transistor causing the transistor to conduct the voltage from the collector 60 to the emitter 64. When this occurs, the relay 66 is powered so as to close a switch 68 formed in a circuit which includes a further device 70. This device 70 may be an additional display device such as a horn or piezoelectric buzzer or other type of audible display, an additional lamp or other visible display, or other switching device to initiate or terminate operation of the apparatus in which the electrical field generator 14 is connected.

It will be readily apparent to a person of ordinary skill in the art that the circuit described, while providing the desired operation, can be configured quite differently to achieve the same results, that is of supplying a signal in response to operation of the electrical field and/or to supply a signal upon detection of the non-operation of the electrical field. The signals thus generated can be used to drive various audible, visible or other types of display devices or to initiate or terminate operation of other devices.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as may invention:

1. A display device for use with an electrical field generator comprising:

a housing for said device;

an electrical conductor extending from a point on said electrical field generator distant from a power supply to a first terminal fixedly secured within said housing;

a second terminal spaced from said first terminal;

means for adjusting the size of a space between said two terminals; and a display means connected at a first end to said second terminal for indicating the presence or absence of an electrical potential at said point on said electrical field generator and connected at an opposite end to an isolator coil;

said display means being perceptible from an exterior of said housing.

2. A display device according to claim 1, wherein said display means comprises at least one of a visual and an audible signalling means for indicating that an electrical potential is present.

3. A signal generating device according to claim 2, wherein said signalling means comprises a neon tube positioned in a visible location.

4. A display device according to claim 1, wherein said display means comprises at least one of a visual and an audible signalling means for indicating that an electrical potential is not present.

5. A display device for use with an electrical field generator comprising:

a housing for said device;

an electrical conductor extending from a point on said electrical field generator distant from a power supply to a first terminal fixedly secured within said housing;

a second terminal spaced from said first terminal;

means for adjusting the size of a space between said two terminals; and a visible display means connected at a first end to said second terminal for indicating the presence or absence of an electrical potential at said point on said electrical field generator and connected at an opposite end to an isolator coil;

said housing having an opening therein to permit viewing of said display means.

6. A display device according to claim 5, wherein said means for adjusting comprises mounting one of said terminals on a threaded shaft received in a threaded aperture fixed relative to said other terminal.

7. A display device according to claim 5, wherein said visual display means comprises a neon tube.

8. A display device according to claim 5, wherein said device further comprises an audible display means operably connected to said visual display means for indicating the presence or absence of an electrical potential at said point on said electrical field generator.

9. A display device according to claim 8, wherein said audible display means is operably connected to said visual display means by a photocell receptor positioned to detect the display of said visual display means.

10. A display device for use with an electrical field generator comprising:

a housing for said device;

an electrical conductor extending from a point on said electrical field generator distant from a power supply to a first brass terminal block fixedly secured within said housing;

a second brass terminal block spaced from said first terminal block;

means for adjusting the size of a space between said two terminal blocks; and a neon display tube connected at a first end to said second terminal for indicating the presence or absence of an electrical potential at said point on said electrical field generator and connected at an opposite end to an isolator coil;

said housing having an opening therein to permit viewing of said neon display.

11. A display device according to claim 10, wherein said means for adjusting comprises mounting said second terminal block on a non-electrically conducting threaded shaft received in a threaded aperture fixed relative to said first terminal block.

12. A display device according to claim 10, wherein said device further comprises an audible display means operably connected to said neon display tube for indicating the presence or absence of an electrical potential at said point on said electrical field generator.

13. A display device according to claim 12, wherein said audible display means is operably connected to said visual display means by a photocell receptor positioned to detect the display of said visual display means.

* * * * *